US008550186B2

(12) United States Patent
Deolalikar et al.

(10) Patent No.: US 8,550,186 B2
(45) Date of Patent: Oct. 8, 2013

(54) ROTARY STEERABLE TOOL EMPLOYING A TIMED CONNECTION

(75) Inventors: Neelesh Deolalikar, Webster, TX (US); Pralay Das, Sugar Land, TX (US)

(73) Assignee: Smith International, Inc., Houston, TX (US)

( * ) Notice: Subject to any disclaimer, the term of this patent is extended or adjusted under 35 U.S.C. 154(b) by 592 days.

(21) Appl. No.: 12/684,217

(22) Filed: Jan. 8, 2010

(65) Prior Publication Data

US 2011/0168444 A1 Jul. 14, 2011

(51) Int. Cl.
*E21B 7/08* (2006.01)
*E21B 17/02* (2006.01)

(52) U.S. Cl.
USPC ..... 175/73; 166/242.6

(58) Field of Classification Search
USPC ..... 166/242.6; 175/73
See application file for complete search history.

(56) References Cited

U.S. PATENT DOCUMENTS

| | | | | |
|---|---|---|---|---|
| 2,373,880 | A | 4/1945 | Driscoll | |
| 2,603,163 | A | 7/1952 | Nixon | |
| 2,874,783 | A | 2/1959 | Haines | |
| 2,880,805 | A | 4/1959 | Nelson et al. | |
| 2,915,011 | A | 12/1959 | Hamill | |
| 3,126,971 | A | 3/1964 | Kellner | |
| 3,196,959 | A | 7/1965 | Kammerer | |
| 4,407,374 | A | 10/1983 | Wallussek et al. | |
| 4,416,339 | A | 11/1983 | Baker et al. | |
| 4,463,814 | A | 8/1984 | Horstmeyer et al. | |
| 4,836,305 | A * | 6/1989 | Curlett | 175/215 |
| 4,844,178 | A | 7/1989 | Cendre et al. | |
| 4,875,713 | A * | 10/1989 | Carstensen | 285/55 |
| 4,947,944 | A | 8/1990 | Coltman et al. | |
| 4,957,173 | A | 9/1990 | Kinnan | |
| 5,070,950 | A | 12/1991 | Cendre et al. | |
| 5,168,941 | A | 12/1992 | Krueger et al. | |
| 5,232,058 | A | 8/1993 | Morin et al. | |
| 5,265,684 | A | 11/1993 | Rosenhauch | |
| 5,603,386 | A | 2/1997 | Webster | |
| 5,797,453 | A | 8/1998 | Hisaw | |
| 5,941,323 | A | 8/1999 | Warren | |
| 6,148,933 | A | 11/2000 | Hay et al. | |
| 6,158,529 | A | 12/2000 | Dorel | |
| 6,290,003 | B1 | 9/2001 | Russell | |
| 6,427,783 | B2 | 8/2002 | Krueger et al. | |
| 6,609,579 | B2 | 8/2003 | Krueger et al. | |
| 6,761,232 | B2 | 7/2004 | Moody et al. | |
| 7,156,676 | B2 * | 1/2007 | Reynolds, Jr. | 439/194 |
| 7,204,325 | B2 | 4/2007 | Song et al. | |
| 7,383,897 | B2 | 6/2008 | Moody et al. | |
| 7,390,032 | B2 * | 6/2008 | Hughes | 285/330 |
| 7,400,262 | B2 * | 7/2008 | Chemali et al. | 340/854.3 |
| 7,426,967 | B2 * | 9/2008 | Sugiura | 175/38 |
| 7,464,770 | B2 | 12/2008 | Jones et al. | |
| 8,181,707 | B2 * | 5/2012 | Evans et al. | 166/380 |
| 2004/0256153 | A1 | 12/2004 | Helms et al. | |
| 2009/0166086 | A1 | 7/2009 | Sugiura | |

FOREIGN PATENT DOCUMENTS

| | | | |
|---|---|---|---|
| EP | 1174582 | A3 | 1/2002 |
| WO | 0151761 | A1 | 7/2001 |
| WO | 03097989 | A1 | 11/2003 |

* cited by examiner

*Primary Examiner* — David Bagnell
*Assistant Examiner* — Robert E Fuller
(74) *Attorney, Agent, or Firm* — Christopher Streinz; Kimberly Ballew

(57) ABSTRACT

A downhole steering tool includes distinct hydraulic and electronics modules deployed about a shaft. The hydraulics module includes a plurality of hydraulically actuated blades. The electronics module includes electronic circuitry configured to control blade actuation. The hydraulics and electronics modules are physically and electrically connected to one another via a timed connection.

14 Claims, 6 Drawing Sheets

10
12
20
30
18
22
16
40
100
150
32

ROTARY STEERABLE TOOL EMPLOYING A TIMED CONNECTION

RELATED APPLICATIONS

None.

FIELD OF THE INVENTION

The present invention relates generally to downhole steering tools. More particularly, the invention relates to a rotary steerable tool including an electronics housing physically and electrically connected to a blade housing via a timed connection.

BACKGROUND OF THE INVENTION

Directional control has become increasingly important in the drilling of subterranean oil and gas wells, with a significant proportion of current drilling activity involving the drilling of deviated boreholes. Such deviated boreholes often have complex profiles, including multiple doglegs and a horizontal section that may be guided through thin, fault bearing strata, and are typically utilized to more fully exploit hydrocarbon reservoirs.

Deviated boreholes are often drilled using downhole steering tools, such as two-dimensional and three-dimensional rotary steerable tools. Certain rotary steerable tools make use of a plurality of independently operable blades that are disposed to extend radially outward from a blade housing into contact with the borehole wall. The direction of drilling may be controlled, for example, by controlling the magnitude and direction of the force on the blades or the magnitude and direction of the displacement applied to the borehole wall. In such rotary steerable tools, the blade housing is typically deployed about a rotatable shaft, which is coupled to the drill string and disposed to transfer weight and torque from the surface (or from a mud motor) through the steering tool to the drill bit assembly. Other rotary steerable tools are known that utilize an internal steering mechanism and therefore don't require blades (e.g., the Schlumberger PowerDrive rotary steerable tools).

Rotary steerable blades are commonly actuated via electronically controlled hydraulic mechanisms. For example, U.S. Pat. Nos. 5,168,941 and 6,609,579 to Krueger et al disclose rotary steerable tool deployments in which the direction of drilling is controlled by controlling the magnitude and direction of a side (lateral) force applied to the drill bit. The amount of force on each blade is controlled by controlling a hydraulic pressure at the blade, which is in turn controlled by proportional hydraulics or by switching to the maximum pressure with a controlled duty cycle. An alternative hydraulic actuation mechanism is further disclosed in which each steering blade is independently controlled by a corresponding hydraulic piston pump. During drilling each of the piston pumps is operated continuously via rotation of a drive shaft. A control valve positioned between each piston pump and its corresponding blade controls the flow of hydraulic fluid from the pump to the blade.

U.S. Pat. No. 5,603,386 to Webster discloses another example of a rotary steerable tool employing electronic control of hydraulic blade actuation. Webster discloses a mechanism in which the direction of drilling is controlled via controlling the radial position of the blades. A hydraulic mechanism is disclosed in which all three blades are controlled via a single pump and pressure reservoir and a plurality of valves. In particular, each blade is controlled by three check valves. The nine check valves are in turn controlled by eight solenoid controlled pilot valves. Commonly assigned U.S. Pat. No. 7,204,325 to Song et al employs hydraulic actuation to extend the blades and a spring biased mechanism to retract the blades. Spring biased retraction of the blades advantageously reduces the number of valves required to control the blades, however, a significant number of controllable components are still required.

The above-described prior art steering tools employ complex electronic circuitry in order to control the hydraulic actuation of the blades. This electronic circuitry is deployed in a common housing with the hydraulic control mechanism and the blades. While such tool deployments are known to be commercially serviceable, there is room for further improvement. For example, deployment of the electronic circuitry and the hydraulic components in a common housing tends to complicate tool assembly procedures (especially in small diameter "slim" tools). Moreover, disassembly of the entire tool is commonly required when problems are identified during assembly or testing of the tool. Such disassembly and the subsequent reassembly are time consuming and expensive. Owing to the demand for smaller diameter and less expensive rotary steerable tools, there is a need for further improvement.

SUMMARY OF THE INVENTION

The present invention addresses the need for improved steering tools. Aspects of the invention include a rotary steerable tool including first and second hydraulic and electronics modules deployed on a shaft. The hydraulics module includes a plurality of hydraulically actuated blades. The electronics module includes electronic circuitry configured to control the blade actuation. The hydraulics and electronics modules are physically and electrically connected to one another via a timed connection.

Exemplary embodiments of the present invention may advantageously provide several technical advantages. For example, the present invention makes use of hydraulics and electronics modules that are configured as stand-alone assemblies. As such, these modules may be essentially fully assembled and tested independent of one another prior to the assembly of the final steering tool. This feature of the invention advantageously simplifies the assembly and testing protocol of the hydraulics and electronics modules and therefore tends to improve tool reliability and reduce fabrication costs. This feature of the invention also tends to improve the serviceability of the tool in that a failed module (or simply a module needing service) may be easily removed from the tool and replaced and/or repaired.

The use of distinct hydraulics and electronics modules tends to be further advantageous in that it provides for physical isolation of the sensitive electronics components from hydraulic oil and drilling fluid in the hydraulics module. Moreover, the invention enables the available volume under the hydraulics sleeve to be used as a hydraulic fluid reservoir, thereby obviating the need for a separate reservoir. This can be particularly advantageous in small diameter tools in which space is at a premium.

In one aspect the present invention includes a downhole steering tool. The steering tool includes an electronics module physically and electrically connected to a hydraulics module via a timed connection. The electronics module and the hydraulics module are deployed about and configured to rotate with respect to a shaft. The hydraulic module includes a plurality of blades deployed on a blade housing, with the blades being disposed to extend and retract radially outward from and inward towards the housing. The electronics housing includes a controller configured to control said extension and retraction of the blades. The timed connection includes a first threaded end configured to be threadably connected with a second threaded end, the first threaded end including at least first and second asymmetrically spaced grooves formed therein, the second threaded end including corresponding first and second asymmetrically spaced slots formed therein. The timed connection further includes a timing ring having a predetermined axial dimension such that the first and second grooves and the corresponding first and second slots become circumferentially aligned when the first and second threaded ends are threaded together to a make-up torque within a predetermined range.

In another aspect the present invention includes a downhole steering tool. The steering tool includes an electronics module physically and electrically connected to a hydraulics module, the electronics module and the hydraulics module being deployed about and configured to rotate with respect to a shaft. The hydraulic module includes a plurality of blades deployed on a blade housing, the blades disposed to extend and retract radially outward from and inward towards the housing. The hydraulic module further includes a first threaded end having a plurality of asymmetrically spaced grooves formed therein. The electronics module includes a controller configured to control said extension and retraction of the blades, the electronics module further including a second threaded end configured to be threadably connected with the first threaded end. The second threaded end includes a plurality of asymmetrically spaced slots formed therein. A timing ring is deployed on one of the hydraulics and electronics modules. The timing ring has a predetermined axial dimension such that corresponding ones of the grooves and slots become circumferentially aligned with one another when the first and second ends are threaded together to a makeup torque in a predetermined range.

In still another aspect the present invention includes a downhole steering tool. The steering tool includes an electronics module physically and electrically connected to a hydraulics module. The electronics module and the hydraulics module are deployed about and configured to rotate with respect to a shaft. The hydraulic module includes a plurality of blades deployed on a blade housing, the blades disposed to extend and retract radially outward from and inward towards the housing. The blade housing includes a first threaded end having a plurality of asymmetrically spaced grooves formed therein. A hydraulics sleeve is deployed about at least a portion of the blade housing. The electronics module includes a controller configured to control said extension and retraction of the blades. The electronics module further includes a second threaded end formed on an electronics housing and configured to be threadably connected with the first threaded end. The second threaded end includes a plurality of asymmetrically spaced slots formed therein. An electronics sleeve is deployed about at least a portion of the electronics housing. A timing ring is deployed about the blade housing and axially between the electronics sleeve and the hydraulics sleeve. The timing ring has a predetermined axial dimension such that corresponding ones of the grooves and slots become circumferentially aligned with one another when the first and second ends are threaded together to a makeup torque in a predetermined range.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
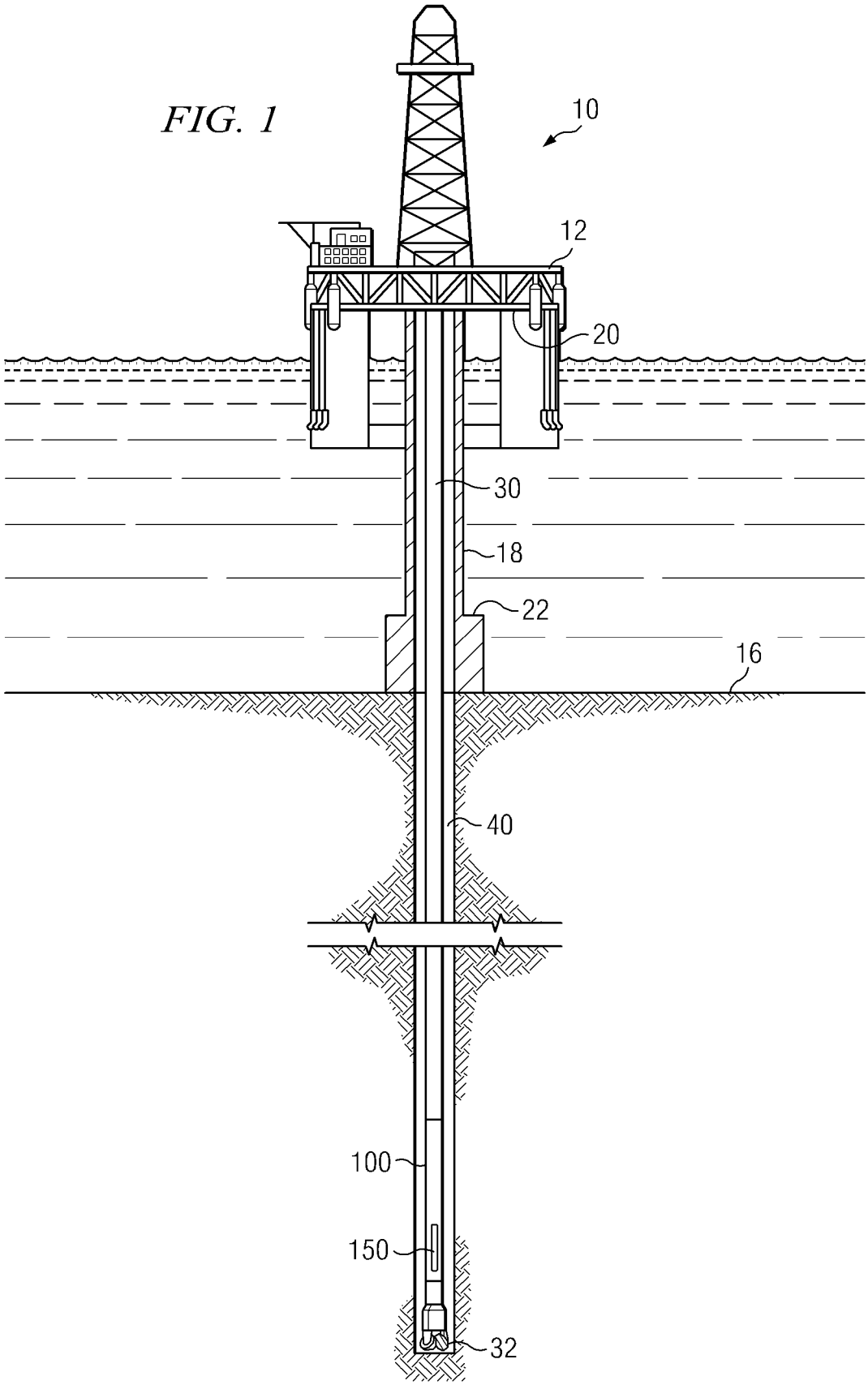
FIG. 1 depicts a drilling rig on which exemplary embodiments of the present invention may be deployed.

Referring first to FIGS. 1 through 7, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 7 may be described herein with respect to that reference numeral shown on other views.

Figure 2:
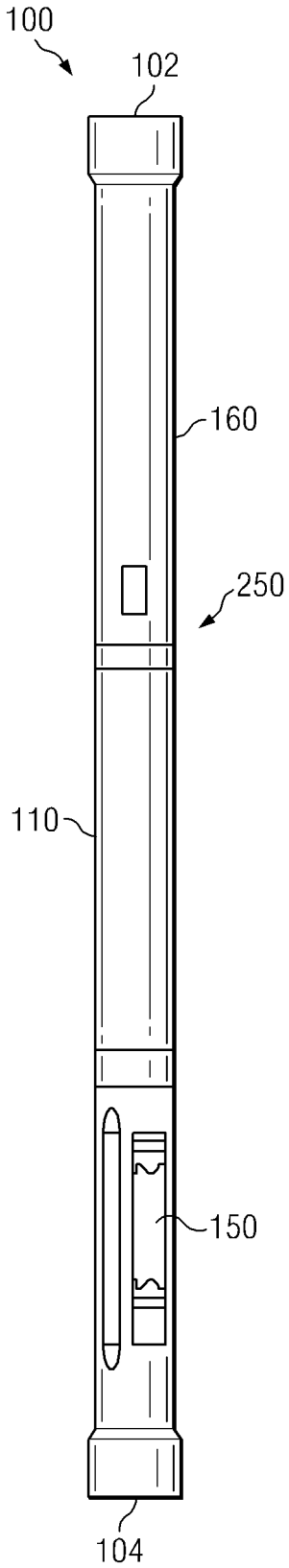
FIG. 2 depicts a perspective view of one exemplary embodiment of the steering tool shown on FIG. 1.

FIG. 1 illustrates a drilling rig 10 suitable for the deployment of exemplary embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes a drill bit 32 and a downhole steering tool 100 (such as a three-dimensional rotary steerable tool). In the exemplary embodiment shown, steering tool 100 includes first and second hydraulics and electronics modules 110 and 160 (FIG. 2). A plurality of blades 150 (e.g., three) are deployed on the hydraulics module 110 and are disposed to extend radially outward from the tool 100 into contact with the borehole wall. In the exemplary embodiment depicted, the extension of the blades 150 into contact with the borehole wall is intended to eccenter the tool in the borehole, thereby changing an angle of approach of the drill bit 32 (which in turn changes the direction of drilling). The electronics module 160 is configured to control hydraulic actuation (extension and retraction) of the blades 150 during drilling. As described in more detail below, the hydraulics and electronics modules 110 and 160 are physically and electrically connected to one another via a timed connection. The drill string 30 may also include various electronic devices, e.g., including a telemetry system, additional sensors for sensing downhole characteristics of the borehole and the surrounding formation, and microcontrollers disposed to be in electronic communication with the electronics module 160. The invention is not limited in regards to specific types or makes of electrical and/or electronic devices.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore.

Figure 4:
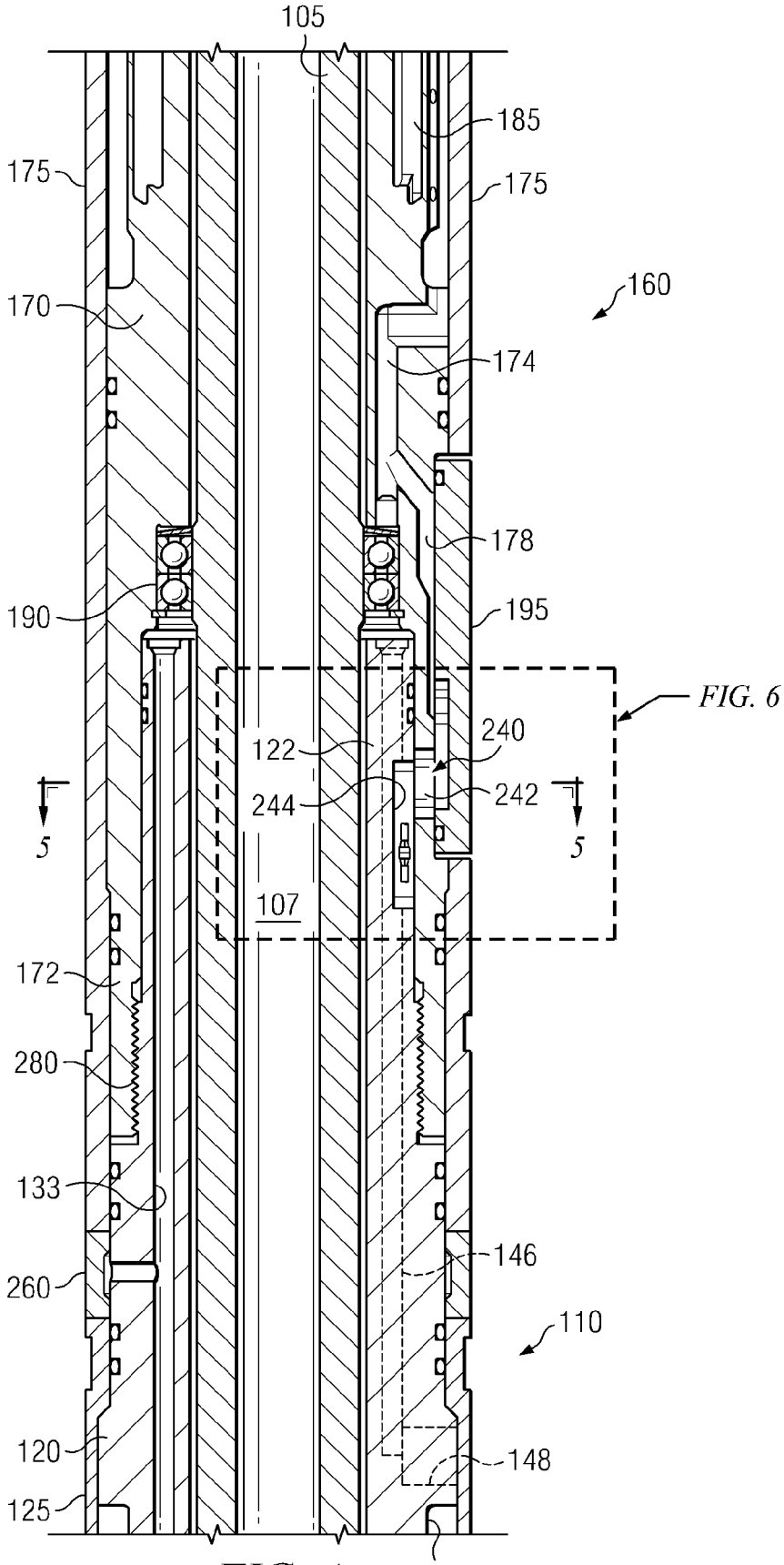
FIG. 4 depicts a longitudinal cross section of a portion of the steering tool embodiment shown on FIG. 2.

Turning now to FIG. 2, one exemplary embodiment of steering tool 100 is depicted in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes distinct hydraulics and electronics modules 110 and 160 that are deployed about, and configured to rotate substantially freely with respect to a shaft 105 (FIG. 4). These modules 110 and 160 are physically and electrically connected to one another via a timed connection as depicted generally at 250. The hydraulics module includes at least one blade 150 deployed, for example, in a recess (not shown) in a blade housing. Preferred embodiments of the invention include three blades 150 deployed at equal angular intervals about the circumference of the blade housing 110, although the invention is expressly not limited in this regard.

Figure 7:
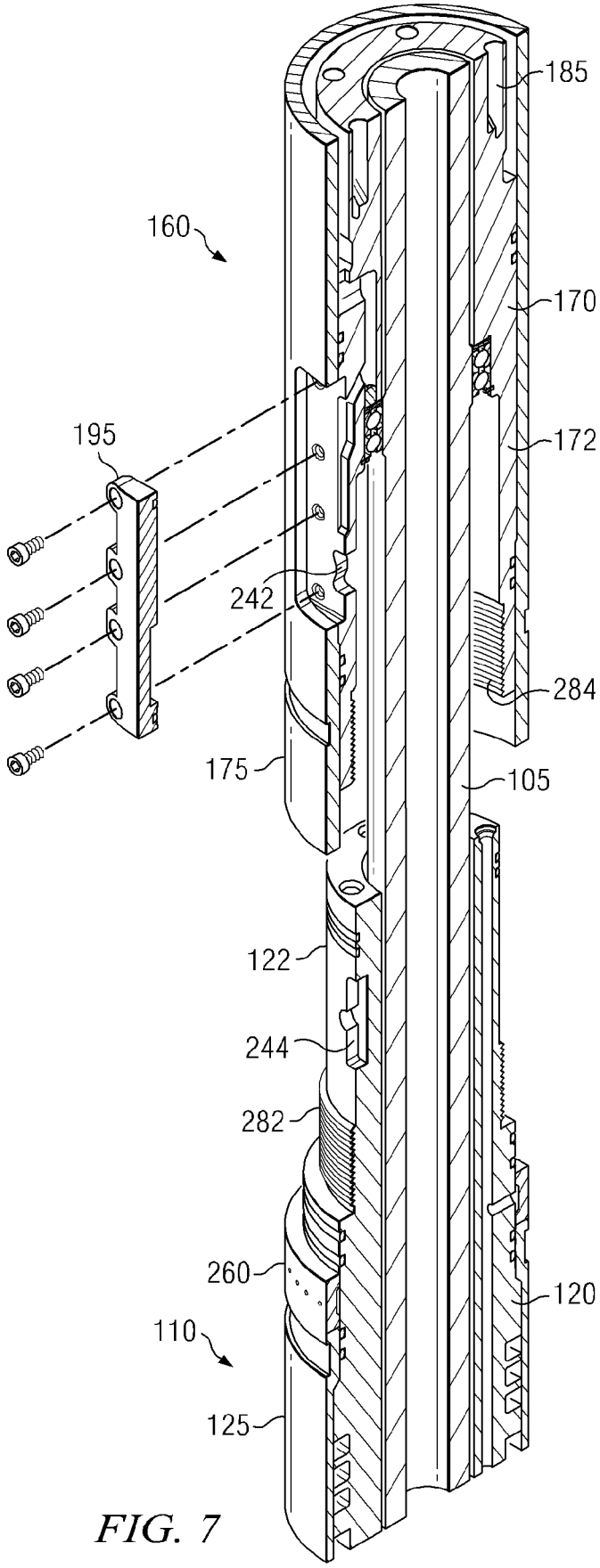
FIG. 7 depicts a partially exploded view of a portion of the steering tool embodiment depicted on FIG. 2.

The hydraulics and electronics modules 110 and 160 are advantageously configured as stand-alone assemblies (as is described in more detail below with respect to FIG. 7). By stand-alone it is meant that each of these modules 110 and 160 may be essentially fully assembled and tested independent of one another prior to being incorporated into the steering tool 100. This feature of the invention advantageously simplifies the assembly and testing protocol of the hydraulics and electronics modules 110 and 160 and therefore tends to improve tool reliability and reduce fabrication costs. This feature of the invention also tends to improve the serviceability of the tool in that a failed module (or simply a module needing service) may be easily removed from the tool and replaced and/or repaired.

The hydraulics module 110 further includes hydraulic circuitry (e.g., including pumps, valves, pistons, sensors, and the like) configured to actuate the extension and retraction of the blades 150. The electronics module 160 is configured to measure and control the direction of drilling and therefore includes electronic circuitry configured to control the hydraulic actuation of the extension and retraction of the blades 150. These modules 110 and 160 may include substantially any hydraulic and electronic devices known to those of skill in the art, for example, as disclosed in U.S. Pat. No. 5,603,386 to Webster, U.S. Pat. No. 6,427,783 to Krueger et al, and commonly assigned U.S. Pat. No. 7,464,770 to Jones et al.

To steer (i.e., change the direction of drilling), one or more of the blades 150 may be extended into contact with the borehole wall. The steering tool 100 may be moved away from the center of the borehole by this operation, thereby altering the drilling path. It will be appreciated that the tool 100 may also be moved back towards the borehole axis if it is already eccentered. To facilitate controlled steering, the rotation rate of the housing is desirably less than about 0.1 rpm during drilling, although the invention is not limited in this regard. By keeping the blades 150 in a substantially fixed position with respect to the circumference of the borehole (i.e., by essentially preventing rotation of the blade housing) it is possible to steer the tool without cyclically extending and retracting the blades 150. The tool 100 is constructed so that the hydraulics and electronics modules 110 and 160 may remain substantially rotationally stationary with respect to the borehole during directional drilling operations. These modules 110 and 160 are therefore constructed in a rotationally non-fixed (or floating) fashion with respect to the shaft 105 (FIG. 4). The shaft 105 is physically connected with the drill string and is disposed to transfer both torque (rotary power) and weight to the bit.

The above-described automatic control and manipulation of the blades 150 is known to require a complex system of electronic circuitry, typically including one or more microprocessors, electronic memory, firmware instructions for control of the tool, and various electronic sensors. This circuitry is typically configured to control the operation of various controllable hydraulic components in the hydraulics module 110, for example, including solenoid-actuated valves and an electric pump. The circuitry is also typically disposed to be in electronic communication with various sensors that are deployed in the hydraulics module 110, for example, including pressure sensors and linear position sensors deployed at each blade 150. Such electronic communication and control commonly requires a large number of electrical conductors (wires) to be routed between the hydraulics and electronics modules 110 and 160 (e.g., from the electronics module to the hydraulics module). The invention advantageously enables substantially any number of wires to be routed between the modules (constrained only physical space within the tool). For example, in one exemplary embodiment of the invention, more than 30 electrical conductors are routed from electronics module 160 through the timed connection 250 to various components in the hydraulics module 110.

Figure 3A:
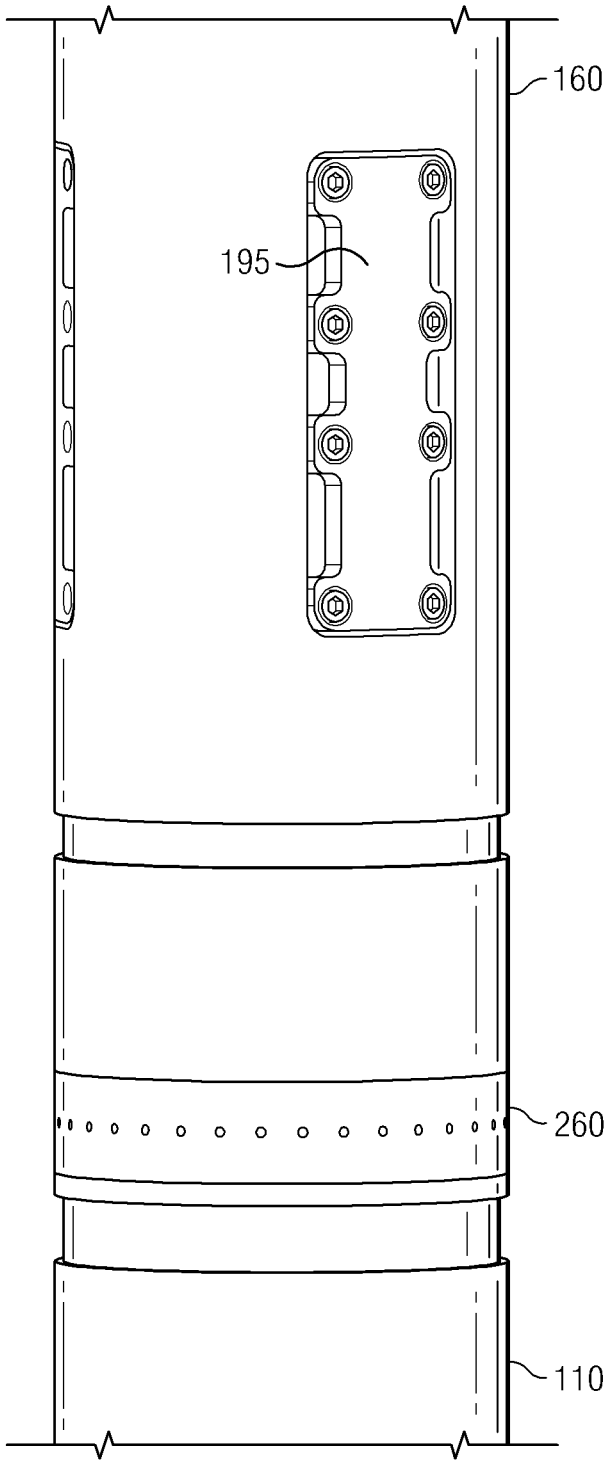
FIGS. 3A and 3B depict a portion of the steering tool shown on FIG. 2 with and without a hatch cover.
Figure 3B:
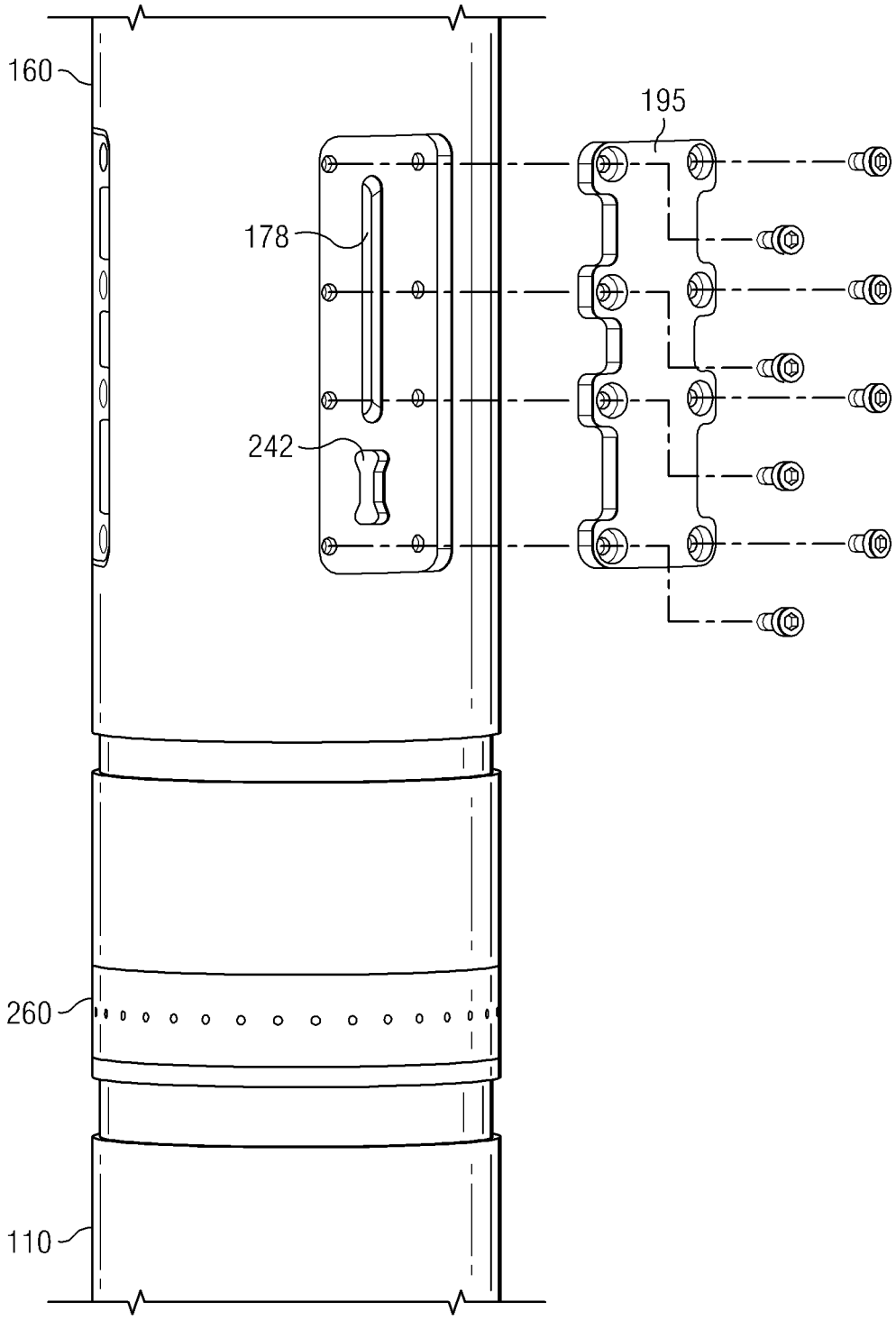

Turning now to FIGS. 3A and 3B, a portion of steering tool 100 is depicted. As described in more detail below, the tool 100 includes a timed connection 250 which physically and electrically connects the hydraulics and electronics modules 110 and 160. FIG. 3A depicts a hatch cover 195 that is configured to sealingly engage an opening in the electronics module 160. In the exemplary embodiment depicted, the electronics module 160 includes an outer sleeve 175 that is deployed about an electronics housing 170. The hatch cover 195 is deployed in a corresponding opening in the sleeve 175 and may therefore function (in part) as an anti-rotation device that prevents the sleeve 175 from rotating with respect to the electronics housing 170. A timing ring 260 is deployed axially between the electronics sleeve 175 and a hydraulics sleeve 125 (which is deployed about at least a portion of the blade housing 120).

Figure 5:
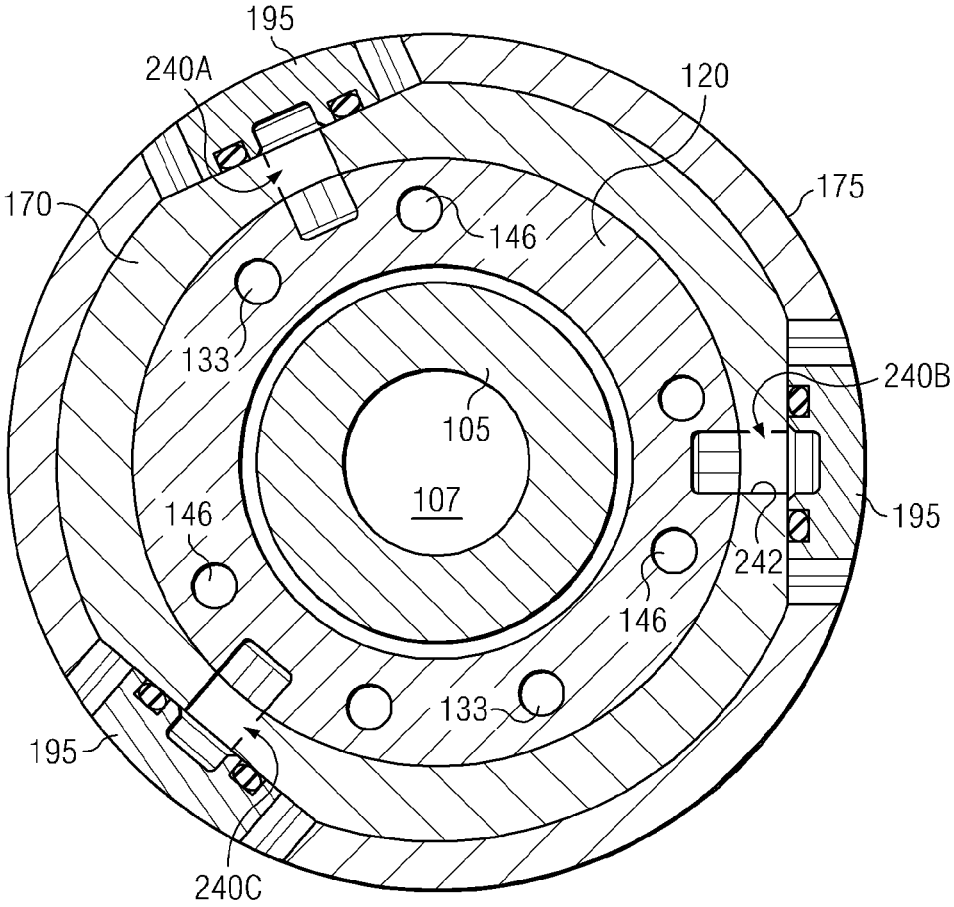
FIG. 5 depicts a circular cross section of the steering tool embodiment shown on FIG. 4.

FIG. 3B depicts a partially exploded view in which the hatch cover 195 is removed from the electronics housing 170. FIG. 3B reveals a slot 242 formed in a box end of the electronics housing 170. As described in more detail below, a corresponding groove 244 is formed in an outer surface of a pin end of the blade housing 120 (FIG. 4). When the connection is properly timed, the slot 242 and the corresponding groove 244 are circumferentially aligned within one another. This circumferential alignment forms a pocket 240 (FIGS. 4 and 5). Removal of the hatch cover 195 (as depicted on FIG. 3B) enables an electrical connection to be made between a first wire harness (FIG. 6) that originates in the electronics module 160 and a second wire harness that originates in the hydraulics module 110. The connected harnesses are deployed in the pocket 240. Redeployment of the hatch cover 195 onto the electronics housing 170 provides a pressure tight seal which is intended to preventingress of drilling fluid into the pocket.

FIGS. 4 and 5 depict a portion of steering tool 100 in longitudinal (FIG. 4) and circular (FIG. 5) cross section. As described above, the hydraulics and electronics modules 110 and 160 are deployed about shaft 105. The shaft 105 includes a through bore 107 for the flow of drilling fluid to the bit. The hydraulics module 110 includes a hydraulics sleeve 125 deployed about at least a portion of the blade housing 120. The aforementioned hydraulic components may be deployed in one or more cavities 135 formed in the housing 120 and located radially between the sleeve 125 and the housing 120. The electronics module 160 includes an electronics sleeve 175 deployed about at least a portion of the electronics housing 170. The aforementioned electronic circuitry may be deployed in one or more cavities 185 formed in the housing 170 and located radially between the sleeve 175 and housing 170. Radial bearings 190 may be deployed, for example, between the electronics housing 170 and the shaft 105.

In the exemplary embodiment depicted, the blade housing 120 includes a pin end 122 that is threadably connected at 280 to the box end 172 of electronics housing 170. A plurality of circumferentially spaced grooves 244 are formed in an outer surface of the pin end 122. Box end 172 includes a corresponding plurality of circumferentially spaced slots 242 formed therein. These grooves 244 and slots 242 are asymmetrically spaced about the circumference of the tool. For example, the grooves 244 may be circumferentially spaced at unequal angular intervals about the circumference of the blade housing 120. The slots 242 may be circumferentially spaced at the same unequal angular intervals about the circumference of the electronics housing. The grooves and slots may also be spaced at equal angular intervals if they are axially offset from one another (e.g. a first groove slot pair located at a first axial position and a second groove slot pair located at a second (different) axial position). In the exemplary embodiment depicted on FIG. 5, three corresponding grooves and slots are axially aligned and angularly spaced at 115, 115, and 130 degrees (the invention is of course not limited to this particular example).

When connecting the hydraulics and electronics modules 110 and 160, corresponding grooves 244 and slots 242 must be rotationally aligned (in order to make the necessary electrical connections). The asymmetric spacing of the grooves 244 and slots 242 ensures that there is only a single relative rotational position between the housings 120 and 170 at which the corresponding grooves 244 and slots 242 can be properly aligned. This in turn ensures a one-to-one correspondence of the conductors in the electronics module 160 with the conductors in the hydraulics module 110. A timing ring 260 is deployed about the blade housing 120 and is located axially between the electronics sleeve 175 and the hydraulics sleeve 125. The timing ring has a predetermined axial dimension such that each of the grooves 244 and their corresponding slots 242 become aligned with one another when a predetermined make-up torque has been applied to the threaded connection during the assembly of the tool. This tool assembly is described in more detail below with respect to FIG. 7.

With continued reference to the exemplary embodiments depicted on FIGS. 4 and 5, routing of the electrical connectors from each of the modules 110 and 160 to the timed connection 250 is now briefly described. In the exemplary embodiment depicted, multiple electrical conductors (e.g., wires) originate at circuitry deployed in the electronics module 160 (e.g., in cavities 185). A number of these conductors are typically bundled to form a harness (e.g., 8 or 12 wires per harness). The exemplary embodiment depicted makes use of three harnesses. Each of these harnesses may be routed through an annular gap located between the electronics sleeve 175 and the electronics housing 170 to a corresponding longitudinal bore 174 in the housing 170. The harnesses extend through the corresponding bores 174 to corresponding recesses 178 formed between an outer surface of the electronics housing 170 and the hatch cover 195 (the recesses may be formed in either or both of the outer surface of the housing 170 and the inner surface of the hatch cover 195). The harnesses are then routed to the corresponding pockets 240 (e.g., pockets 240A, 240B, and 240C depicted on FIG. 5).

Figure 6:
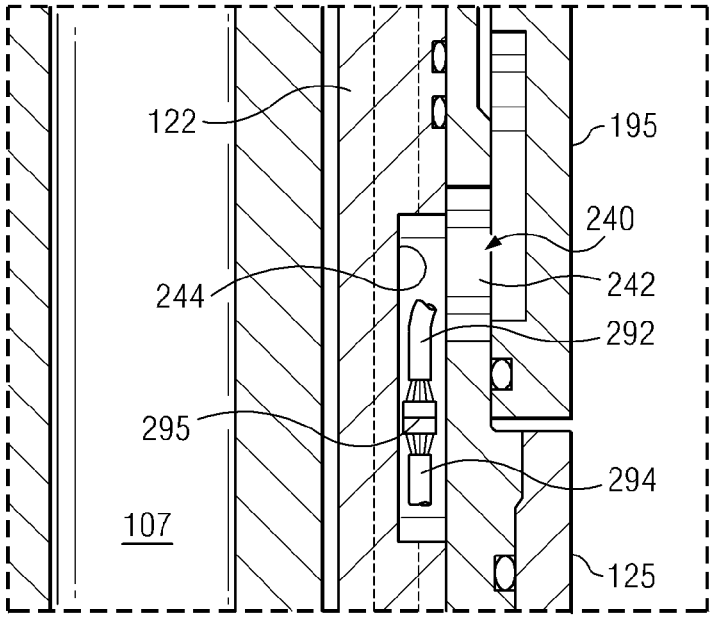
FIG. 6 depicts a longitudinal cross section of the pocket shown on FIG. 4.

Multiple electrical conductors are also routed from the various controllable components in the hydraulics module 110 to the timed connection 250. In the exemplary embodiment depicted, these conductors are routed to (and connected to) at least one bulkhead 148. The bulkhead 148 is intended to provide a pressure tight seal between hydraulic oil and drilling fluid in the hydraulics module 110 and the electronics module 160. The conductors may then be bundled into harnesses and routed from the bulkhead 148 through corresponding gun bores 146 to the corresponding pockets 240 (e.g., 240A, 240B, and 240C). Electrical connectivity between the hydraulics 110 and electronics 160 modules may be established by connecting the corresponding harnesses in each of the pockets (e.g., using standard multiple pin electrical connectors). FIG. 6 depicts electronics harness 292 connected with hydraulics harness 294. The harnesses are electrically connected with one another and deployed in the pocket (as depicted at 295).

As described above with respect to FIG. 2, the hydraulics and electronics modules 110 and 160 are configured as standalone assemblies that may be essentially fully assembled and tested independent of one another prior to being incorporated into the steering tool 100. These modules may then be deployed on the shaft 105 as depicted on FIG. 7. In the exemplary embodiment depicted, the steering tool is assembled from top to bottom. As such the fully assembled electronics module 160 is slidably received on the shaft 105. The fully assembled hydraulics module 110, including the blades 150 and timing ring 260, may also be slidably received on the shaft 105 such that the pin end 122 of the blade housing 120 engages the box end 172 of the electronics housing 170. The hydraulics and electronics modules 110 and 160 are rotated with respect to one another such that threads 282 formed on the outer surface of pin end 122 engage threads 284 formed on the inner surface of the box end 172.

Relative rotation of the hydraulics and electronics modules 110 and 160 continues until a predetermined make-up torque (or a make-up torque in a predetermined range) has been applied to the threaded connection. Those of ordinary skill in the downhole arts will readily appreciate that threaded connections in downhole tools are commonly tightened to a predetermined torque with the intention of preventing disconnection of the threaded ends during downhole operations. As the threaded connection is tightened, the timing ring 260 is compressed between the hydraulics sleeve 125 and the electronics sleeve 175 (which in turn compresses the sleeves 125 and 175). The timing ring is fabricated with a predetermined axial dimension such that the grooves 244 in pin end 122 become circumferentially aligned with the corresponding slots 242 in the box end 172 when the predetermined make-up torque (or a make-up torque in a predetermined range) has been applied.

In one exemplary embodiment of the invention, the steering tool 100 may include a custom-sized timing ring. Proper sizing of the timing ring 260 may be achieved, for example as follows. The hydraulics module 110 may be fitted with a standard sized timing ring and then threadably connected to the electronics module 160 as described above. After applying the predetermined make-up torque, the angular mismatch between the corresponding grooves 244 and slots 242 is measured (e.g., via scribe marks on external surfaces of the sleeves). This angular mismatch is then used to determine (e.g., via a look up table) a required reduction in the axial dimension of the timing ring 260. The timing ring may then be faced off (machined) so as to reduce its axial dimension the prescribed amount. The steering tool 100 is then reassembled as described above with the custom-sized timing ring 260 to establish a physical connection between the hydraulics and electronics modules 110 and 160. An electrical connection may be established via connecting the aforementioned wire harnesses in pockets 240 (as described above with respect to FIGS. 4 and 5). The hatch covers 195 may then be deployed in place as described above with respect to FIGS. 3A and 3B.

In the exemplary embodiments depicted, the hydraulics module 110 includes a reservoir of hydraulic oil that this is modulated to the hydrostatic pressure of the borehole via an equalizer piston (the reservoir and piston are not shown). Drilling fluid in the borehole annulus is in fluid communication with the equalizer piston via the perforated timing ring 260 and one or more bores 133 (FIGS. 4 and 5). It will be readily understood to those of ordinary skill in the art that the drilling fluid in the borehole exerts a force on the equalizer piston proportional to the hydrostatic pressure in the borehole, which in turn pressurizes the hydraulic fluid in the reservoir. In these particular embodiments of the invention, the timing ring 260 further functions as a filter screen through which the drilling fluid may enter the hydraulics module 110. The invention is in no way limited in these regards.

Although the present invention and its advantages have been described in detail, it should be understood that various changes, substitutions and alternations can be made herein without departing from the spirit and scope of the invention as defined by the appended claims.

We claim:

1. A downhole steering tool configured to operate in a borehole, the steering tool comprising:

a shaft;

an electronics module physically and electrically connected to a hydraulics module, the electronics module and the hydraulics module being deployed about the shaft and configured to rotate with respect to the shaft;

the hydraulics module including a plurality of blades deployed on a blade housing, the blades disposed to extend and retract radially outward from and inward towards the housing, the hydraulics module further including a first threaded end having a plurality of grooves formed therein;

the electronics module including a controller configured to control said extension and retraction of the blades, the electronics module further including a second threaded end configured to be threadably connected with the first threaded end, the second threaded end including a plurality of slots formed therein; and wherein corresponding ones of the grooves and slots become circumferentially aligned with one another when the first and second ends are threaded together, said circumferentially aligned grooves and slots forming corresponding pockets in which electrical connections are made between the electronics and hydraulics modules.

2. The steering tool of claim 1, wherein the first threaded end comprises at least first, second, and third grooves formed therein and the second threaded end comprises corresponding first, second, and third slots formed therein.

3. The steering tool of claim 1, wherein the timed connection further comprises a removable hatch cover deployed over each of the slots formed in the second threaded end.

4. The steering tool of claim 1, wherein the grooves are circumferentially spaced at unequal angular intervals about a circumference of the first threaded end and the slots are circumferentially spaced at said unequal angular intervals about the circumference of second threaded end.

5. The steering tool of claim 1, wherein:

the hydraulics module includes an outer hydraulics sleeve;

the electronics module includes an outer electronics sleeve; and a timing ring is deployed axially between the hydraulics sleeve and the electronics sleeve.

6. The steering tool of claim 5, wherein the timing ring is compressed between the outer hydraulics sleeve and the outer electronics sleeve when the first and second threaded ends are threadably connected.

7. The steering tool of claim 5, wherein the timing ring has a predetermined axial dimension such that corresponding ones of the grooves and slots become circumferentially aligned with one another when the first and second ends are threaded together to a makeup torque in a predetermined range.

8. A downhole steering tool configured to operate in a borehole, the steering tool comprising:

a shaft;

an electronics module physically and electrically connected to a hydraulics module, the electronics module and the hydraulics module being deployed about the shaft and configured to rotate with respect to the shaft;

the hydraulics module including a plurality of blades deployed on a blade housing, the blades disposed to extend and retract radially outward from and inward towards the housing, the blade housing including a first threaded end having a plurality of grooves formed therein, the hydraulics module further including a hydraulics sleeve deployed about at least a portion of the blade housing;

the electronics module including a controller configured to control said extension and retraction of the blades, the electronics module further including a second threaded end formed on an electronics housing and configured to be threadably connected with the first threaded end, the second threaded end including a plurality of slots formed therein, the electronics module further including an electronics sleeve deployed about at least a portion of the electronics housing;

a removable hatch cover deployed over each of the slots formed in the second threaded end of the electronics module, the hatch covers being deployed in corresponding openings in the electronics sleeve; and wherein corresponding ones of the grooves and slots become circumferentially aligned with one another when the first and second ends are threaded together.

9. The steering tool of claim 8, wherein said circumferentially aligned grooves and slots form corresponding pockets in which electrical connections are made between the electronics and hydraulics modules.

10. The steering tool of claim 8, further comprising a timing ring is compressed between the electronics sleeve and the hydraulics sleeve when the first and second threaded ends are threadably connected.

11. The steering tool of claim 10, wherein threadably connecting the first and second threaded ends further compresses the electronics sleeve and the hydraulics sleeve.

12. The steering tool of claim 10, wherein the timing ring has a predetermined axial dimension such that corresponding ones of the grooves and slots become circumferentially aligned with one another when the first and second ends are threaded together to a makeup torque in a predetermined range.

13. The steering tool of claim 8, wherein the electronics module comprises electronics circuitry deployed in at least one cavity formed in the electronics housing and located radially between the electronics housing and the electronics sleeve.

14. The steering tool of claim 8, wherein the hydraulics module comprises a plurality of electronically controllable hydraulic components deployed in at least one cavity formed in blade housing and located between the blade housing and the hydraulics sleeve.

* * * * *